US007561669B2

(12) United States Patent
Thangamani et al.

(10) Patent No.: US 7,561,669 B2
(45) Date of Patent: Jul. 14, 2009

(54) METHOD AND SYSTEM FOR THERMAL CONTROL IN X-RAY IMAGING TUBES

(75) Inventors: Arunvel Thangamani, Bangalore (IN); Jayaprakash Ramakrishna, Karnataka (IN)

(73) Assignee: General Electric Company, Schenectady, NY (US)

( * ) Notice: Subject to any disclaimer, the term of this patent is extended or adjusted under 35 U.S.C. 154(b) by 20 days.

(21) Appl. No.: 10/860,516

(22) Filed: Jun. 3, 2004

(65) Prior Publication Data

US 2005/0281380 A1 Dec. 22, 2005

(51) Int. Cl.
*H01J 35/10* (2006.01)
*H01J 35/00* (2006.01)

(52) U.S. Cl. ..... 378/127; 378/144

(58) Field of Classification Search ..... 250/233, 250/236, 237, 491.1; 378/37, 157, 206, 127, 378/128, 141, 142, 199, 143, 144; 403/273; 428/613; 384/277–279, 912, 913
See application file for complete search history.

(56) References Cited

U.S. PATENT DOCUMENTS

| | | | | |
|---|---|---|---|---|
| 2,175,707 | A * | 10/1939 | Shardlow | 313/257 |
| 3,582,457 | A * | 6/1971 | Barthell | 138/140 |
| 4,135,553 | A * | 1/1979 | Evans et al. | 138/141 |
| 4,344,012 | A * | 8/1982 | Hubner et al. | 378/144 |
| 4,462,148 | A * | 7/1984 | Joyce | 29/447 |
| 4,631,973 | A * | 12/1986 | Eley | 74/439 |
| 4,759,110 | A * | 7/1988 | Rieger et al. | 29/447 |
| 4,984,927 | A * | 1/1991 | Kojima et al. | 403/30 |
| 4,991,991 | A * | 2/1991 | Ito et al. | 403/30 |
| 5,585,163 | A * | 12/1996 | Yoshikawa et al. | 428/133 |
| 6,431,781 | B1 * | 8/2002 | Schenk | 403/29 |
| 6,608,429 | B1 * | 8/2003 | Snyder | 313/36 |
| 6,672,786 | B2 * | 1/2004 | Schenk | 403/30 |

FOREIGN PATENT DOCUMENTS

JP 60063864 A * 4/1985

OTHER PUBLICATIONS

Sullins, A.D., et al., AIAA 2001-2819 Effective Thermal Conductivity of High Porosity Open Cell Nickel Foam, Jun. 11-14, 2001, American Institute of Aeronautics and Astronautics, 35th AIAA Thermophysics Conference, pp. 1-11.*

Alan D.Sullins, Kamran Daryabeigi; Effective Thermal Conductivity of High Porosity open cell nickel foam; 35th AIAA Thermophysics Conference, Anaheim, California, AIAA 2001-2819, Jun. 11-14, 2001, pp. 12.

L.P. Lefebere, M. Gauthier, M.N. Bureau et al; Properties of Nickel Foams having different pore size distributions and densities;Proceedings of the 3rd International Conference on Cellular Metals and Metal Foaming Technology, Berlin, Jun. 23-25, 2003, p. 475.

Kamran Daryabeigi; Heat transfer in High Temperature Fibrous Insulation; AIAA 2002-3332; 8th AIAA/ASME Joint Thermophysics and Heat Transfer Conference Jun. 24-26, 2002 / St. Louis, MO.

* cited by examiner

*Primary Examiner*—Edward J Glick
*Assistant Examiner*—Anastasia Midkiff
(74) *Attorney, Agent, or Firm*—Armstrong Teasdale LLP

(57) ABSTRACT

Methods and systems for providing thermal insulation in an X-ray tube are provided. The method includes configuring a metallic foam to resist the heat flow in an X-ray tube. The method further comprises configuring the metallic foam for positioning in the X-ray tube to resist heat flow to bearings in the X-ray tube.

28 Claims, 10 Drawing Sheets

METHOD AND SYSTEM FOR THERMAL CONTROL IN X-RAY IMAGING TUBES

BACKGROUND OF THE INVENTION

The present invention relates generally to medical imaging systems. More particularly, the present invention relates to methods and systems for thermal management in X-ray and other imaging tubes.

Imaging tubes such as X-ray tubes, CT tubes and vascular tubes often operate at high average power loads for long durations of time. For example, cardiovascular tubes used for bypass surgery may run continuously for more than forty minutes at high operating loads. This results in high thermal stresses on the various components inside the tubes.

An X-ray tube typically includes a casing and an insert with a cathode assembly and a rotating anode assembly acting as the target. The anode assembly includes a target member, which is rotated at a high speed by attaching the target to a large rotor with the rotor forming the armature of a motor. The rotor typically rotates on a highly specialized ball bearing system.

When X-ray tubes are operated at a high average power, such as five kilowatts (KW) or more, the bearings experience high thermal stresses due to the increased temperature when the bearings are continuously operated at temperatures higher than the safe temperature limit for their operation, the life of the bearings decreases exponentially, thereby resulting in early failure. This is due in part to premature decreases in the critical mechanical properties of the bearings, such as hardness and yield strength. Thus, it is important to provide adequate heat insulation to the bearings.

Existing thermal barriers in such systems may not provide sufficient heat insulation to the bearings. This is because thermal management in the imaging tubes is restricted by the operating conditions, which include a very low pressure (e.g., $10^{-3}$-$10^{-6}$ torr) and very high temperatures in the order of 800 degrees Celsius (C) or more near the bearing hub inside the tube. Most thermal management materials undergo severe physical and chemical degradation in the form of oxidation under such conditions. An effective thermal management material also needs to be vacuum compatible. Other constraints also are present, such as electrical conductivity to allow high voltage to pass through the anode and cathode. The strength of the material also is a key factor that affects its use as a good insulation material. In addition, known thermal management materials have complex thermal insulator configurations that may require many design changes in existing tubes, thus increasing the cost of manufacture.

Thus, known imaging tube designs do not provide effective thermal management to the bearings and other components in the system at high operating loads. Further, these systems are not flexible enough to operate for long durations at high operating loads.

BRIEF DESCRIPTION OF THE INVENTION

In one embodiment, a method for providing thermal insulation in an X-ray tube is provided. The method includes configuring a metallic foam to resist the heat flow in the X-ray tube. The method further comprises configuring the metallic foam for positioning in the X-ray tube to resist heat flow to bearings in the X-ray tube.

In another embodiment, an X-ray tube is provided. The X-ray tube includes an X-ray tube target member, a thermal barrier member connected to the X-ray tube member and a metallic thermal resisting foam between the X-ray tube target member and the thermal barrier member. The metallic foam is configured to resist heat flow to bearings in the X-ray tube.

DETAILED DESCRIPTION OF THE INVENTION

The various embodiments of the present invention provide methods and systems for thermal protection of components in X-ray tubes. For example, a vacuum compatible metallic foam may be configured and positioned in the X-ray tube to protect the bearings from thermal stresses.

Figure 1:
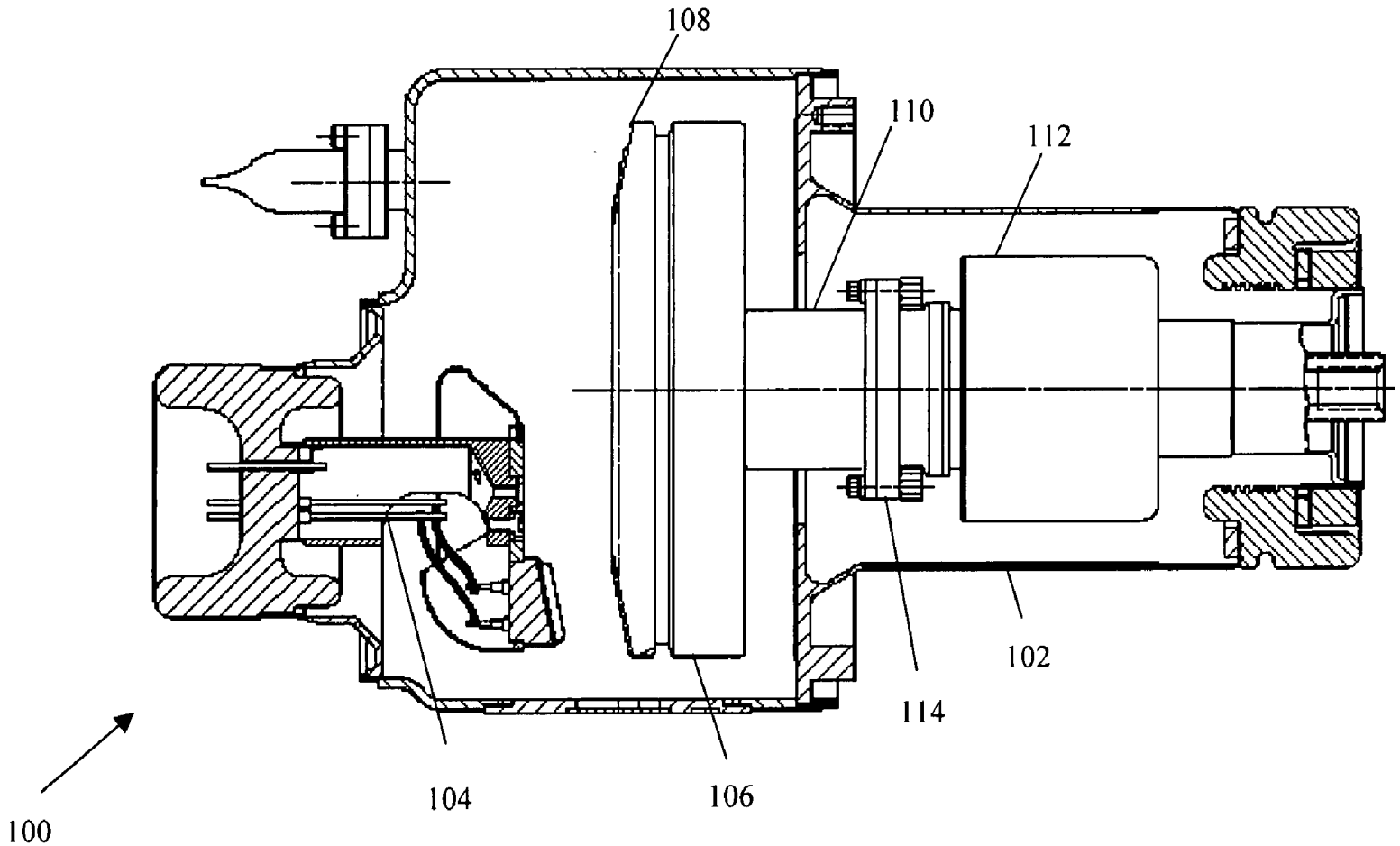
FIG. 1 is a cross-sectional view of an X-ray tube in connection with which various embodiments of the present invention may be implemented.

FIG. 1 is a cross-sectional view of an exemplary X-ray tube in connection with which various embodiments of the present invention may be implemented. An X-ray tube 100 includes a metallic insert 102 within a casing. Insert 102 provides a housing for a cathode assembly 104 and an anode assembly 106. A high vacuum in the order of $10^{-3}$-$10^{-6}$ torr is typically maintained within insert 102. Anode assembly 106 includes a target member 108 connected to a rotor mechanism 112 through a target neck member 110. Target member 108 is subjected to a focused stream of electrons emanating from cathode assembly 104. Rotor 112 spins on internal bearings and enables target member 108 to rotate at high speed during operation. A thermal barrier member 114 is coupled with target member 108 and target neck member 110 for providing thermal insulation in the anode assembly 106.

Figure 2:
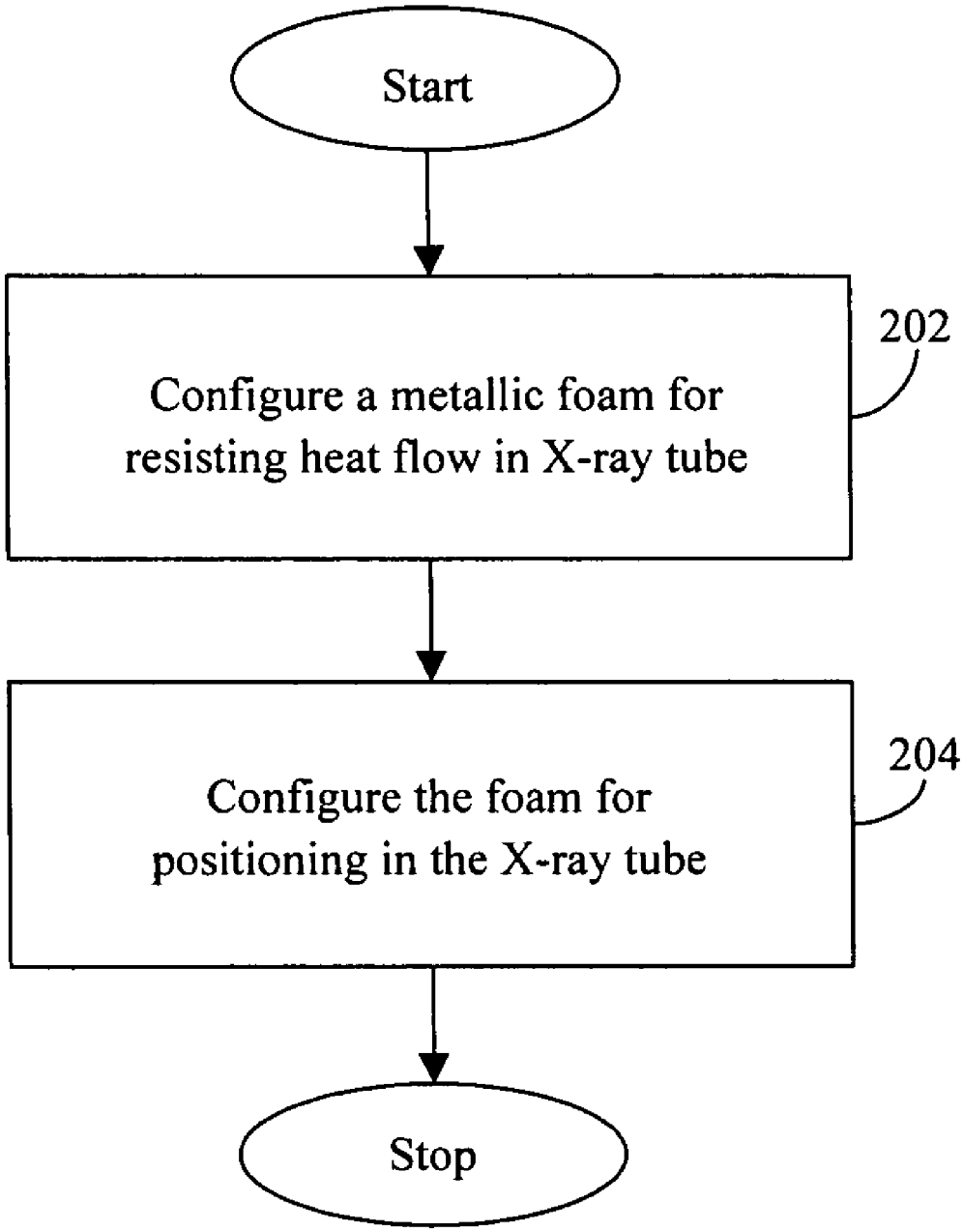
FIG. 2 is a flowchart illustrating a process for providing a metallic foam in accordance with various embodiments of the present invention.

FIG. 2 is a flowchart illustrating a process for providing a metallic foam in accordance with various embodiments of the present invention. At 202, a metallic foam is configured, for example, processed for resisting heat flow in X-ray tube 100 (shown in FIG. 1) as described herein. The metallic foam provides a thermal management material for protection of components (e.g., resist heat flow) such as bearings of the anode target member 108 (shown in FIG. 1). The metallic foam processed at 202, in one embodiment, can sustain high temperatures, for example, of about 800 degrees C. or more and high vacuum levels, for example, about $10^{-3}$ torr to about $10^{-6}$ torr. At these vacuum levels, the metallic foam does not deform physically and remains stable in its chemical composition. Further, the metallic foam does not oxidize and degrade to a powder form. The metallic foam also has a very low thermal conductivity while not affecting the electricity flow path.

At 204, the metallic foam is configured, for example, formed for positioning at a suitable location in the X-ray insert for effective thermal management (e.g., to resist heat flow to bearings). In one embodiment, this includes providing the foam in a structure such that minimal design changes are required in the insert 102 (shown in FIG. 1). The metallic foam is formed with minimum thickness and cross-sectional area for space compatibility in the insert 102. In addition, the position for the foam in the X-ray tube 100 is determined based on the configuration and operating characteristics of the X-ray tube.

For example, vascular tubes operating for extended durations, such as more than forty minutes, typically operate at 5 kilowatts (kW) average power and about 82 kW peak power at a voltage of about 120 kilo volts (kV). In such applications, one of the areas most susceptible to wear due to thermal stresses is the bearing hub at the ends of the rotating shaft of the rotor mechanism 112 (shown in FIG. 1) attached to the target member 108 (shown in FIG. 1). The thermal barrier member 114 (shown in FIG. 2) coupled to the target neck member 110 (shown in FIG. 2) may not provide adequate thermal protection of the bearings under high operating loads and extended operation hours. The safe limit for operation of most types of bearings is approximately 450-500 degrees Celsius (C). An increase in temperature beyond the safe limit may cause severe wear and tear of the bearings leading to failure. This is due to the degrading of the hardness, yield strength and other critical mechanical properties of the bearings with increasing temperatures.

In order to protect the bearings from thermal stresses, various embodiments of the present invention provide a metallic foam positioned in an anode assembly. Alternatively, and in other embodiments, the metallic foam may be positioned at other locations within the X-ray insert such as, for example, the cathode assembly, for protection of other components from thermal stresses.

Figure 3:
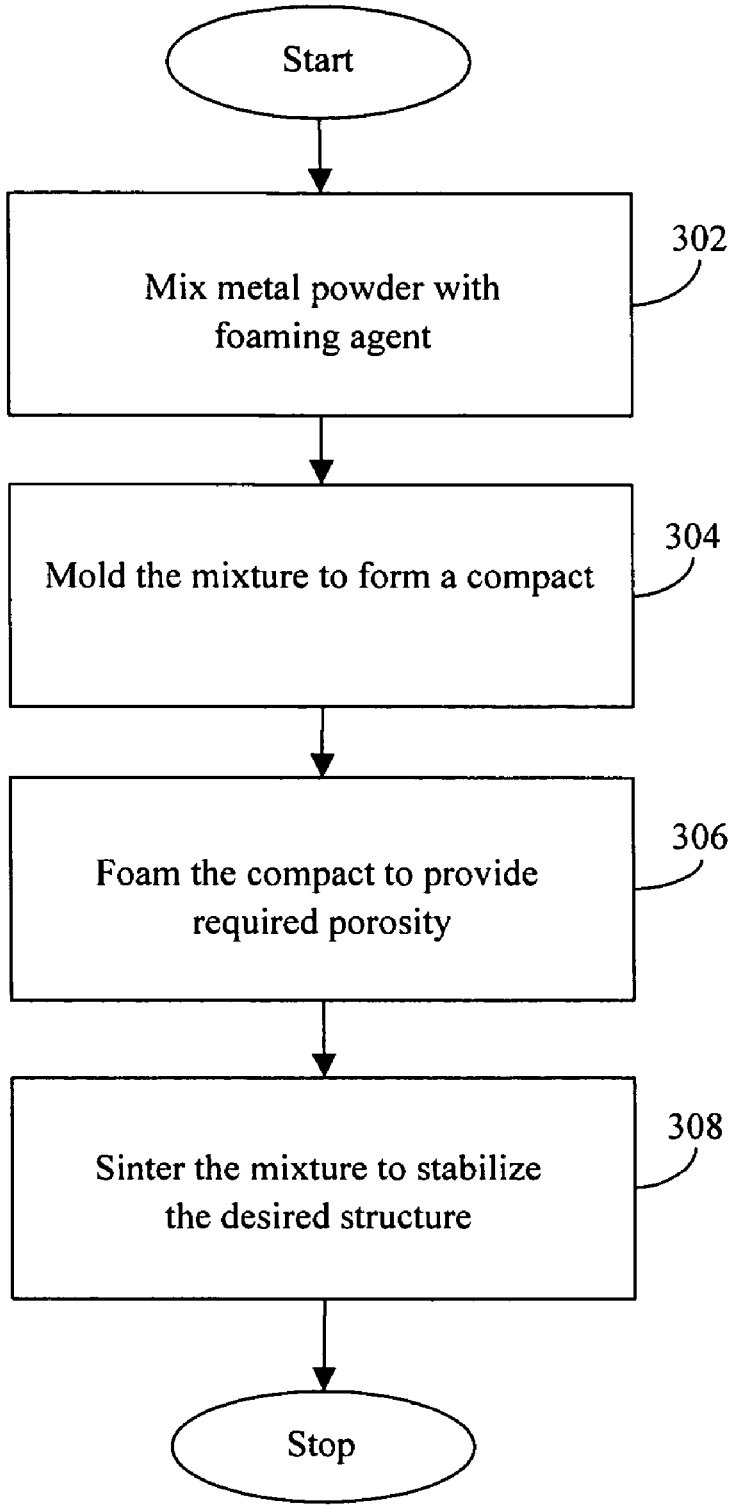
FIG. 3 is a flowchart illustrating a process to configure a metallic foam in accordance with an exemplary embodiment of the present invention.

FIG. 3 is a flowchart illustrating the process to configure, and in particular, form a metallic foam to resist heat flow in accordance with exemplary embodiments of the present invention. At 302, a metal powder is mixed with a foaming agent. The foaming agent is added to provide a porous foam structure. The powder-foaming agent mixture is then molded using a binder at 304 to yield a dense compact. The compact serves as the precursor metal matrix that is subsequently processed to yield the metallic foam. Compaction can be provided using any of various known compacting processes. Examples of such compaction methods include, but are not limited to uniaxial or isostatic compression, rod extrusion and powder rolling.

At 306, the precursor matrix is foamed by heat-treating the compact at temperatures near the melting point of the matrix material. The foaming agent, which is homogeneously distributed within the dense metallic matrix, decomposes and releases gas bubbles, which expand and result in a highly porous structure. Finally, at 308, the foamed matrix is stabilized through sintering the compact. This results in a stable, open-cell, high porosity metallic foam insulator. In one embodiment, the porosity of the metallic foam is higher than about eighty percent (80%) and more specifically, higher than ninety percent (90%).

It should be noted that the above-described process for providing metallic foam is only exemplary in nature and is in no way intended to limit the scope of the various embodiments of the present invention, which may be implemented using other similar processes for metallic foam preparation. Various such methods are known in the art. These include, for example, use of molten metals with adjusted viscosities instead of metallic powders, foaming by external injection of gases, use of a polymer foam template for producing the metallic foam, etc.

Figure 4:
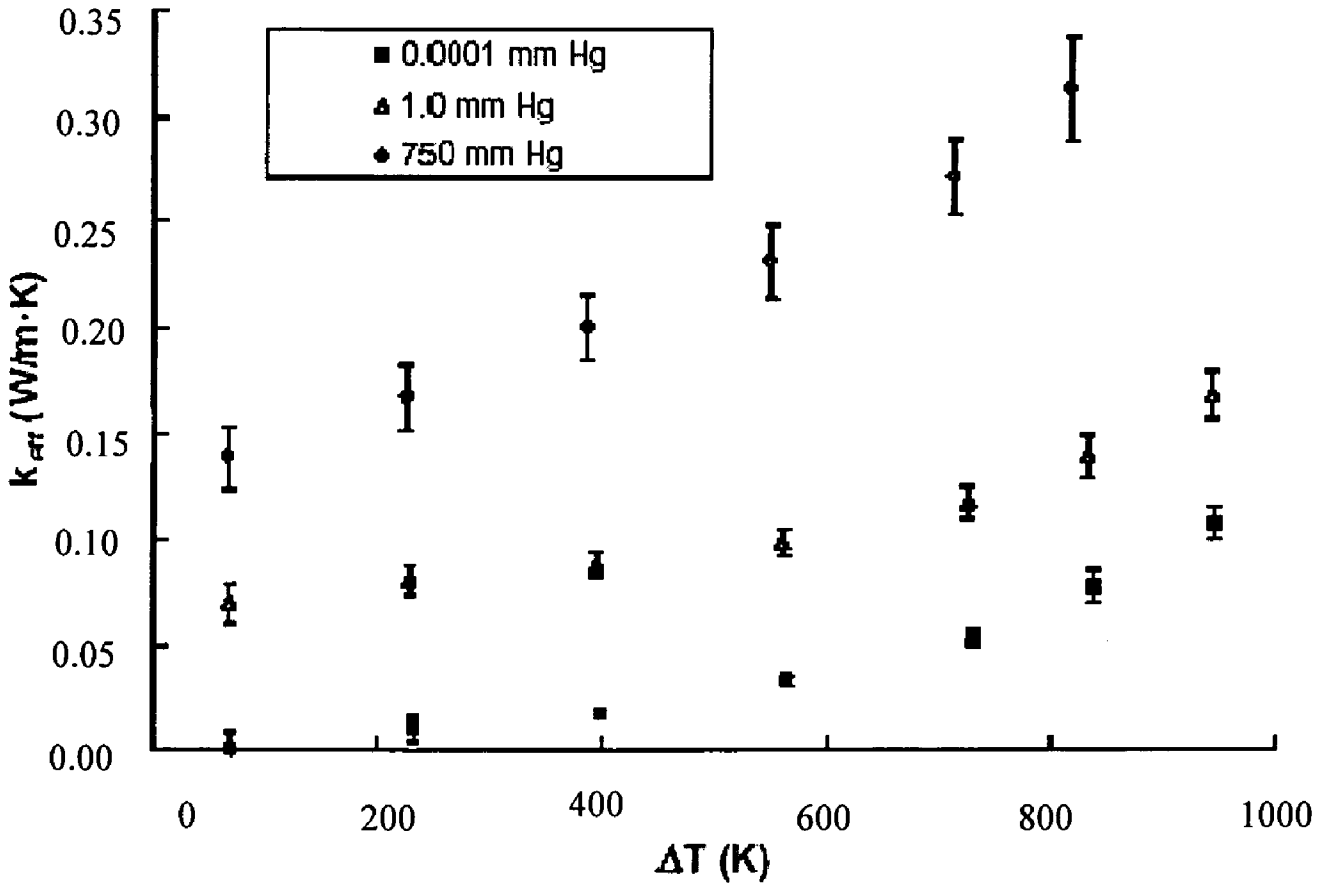
FIG. 4 is a chart illustrating the effective thermal conductivity of nickel foams at various pressure levels.

In various embodiments, nickel is used to produce and/or provide the metallic foam. FIG. 4 illustrates the effective thermal conductivity of nickel foams at various pressure levels. It should be noted, however, that other metallic foams such as Aluminium foams and Titanium foams may be provided in connection with the various embodiments of the present invention.

Figure 5:
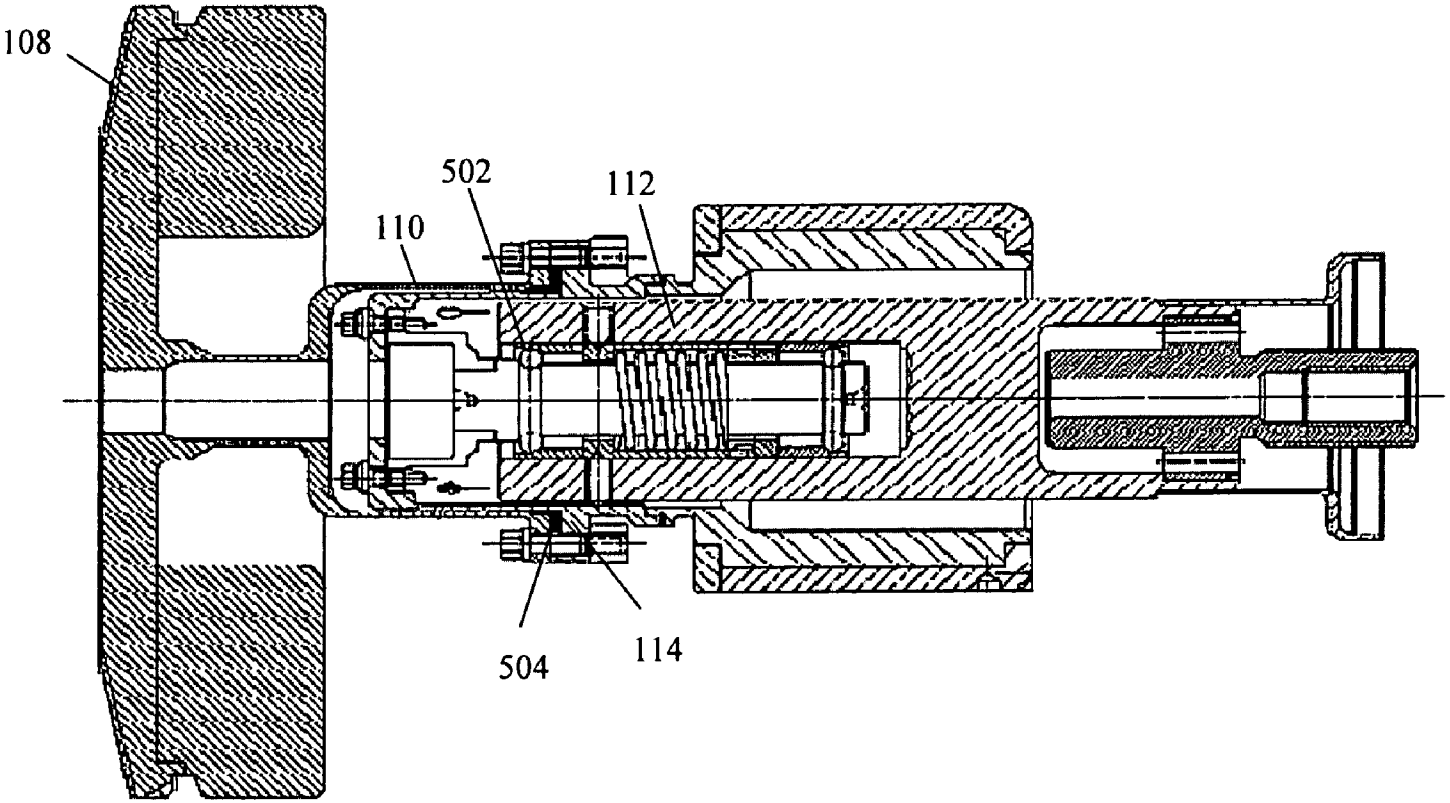
FIG. 5 is a cross-sectional view of an X-ray tube having an rotating-anode type target member in connection with which various embodiments of the present invention may be implemented.

FIG. 5 is a cross-sectional view of an X-ray tube having a rotating-anode type target member in accordance with an embodiment of the present invention. Target member 108 is coupled with rotor 112 via bolted joints in target neck member 110. Rotor 112 rotates on internal ball bearings 502, which may be sensitive and/or susceptible to thermal stresses. Thermal barrier member 114 provides thermal insulation to various internal components. Thermal barrier member 114 may be constructed of a rigid superalloy material, such as, for example, Incoloy. However, additional thermal insulation to bearings 502 at high operating loads for long durations may be needed. Based in part on the dimensional constraints and mechanical strength of Nickel foams as described herein, the bolted joint between target neck member 110 and thermal barrier 114 is provided with a metallic foam 504 in various embodiments of the present invention. This also provides positioning of the metallic foam 504 also ensures an electrical conductivity path for current to pass through the bolts. The coupling of metallic foam 504 with thermal barrier 114 is explained in more detail in connection with FIG. 6.

Figure 6:
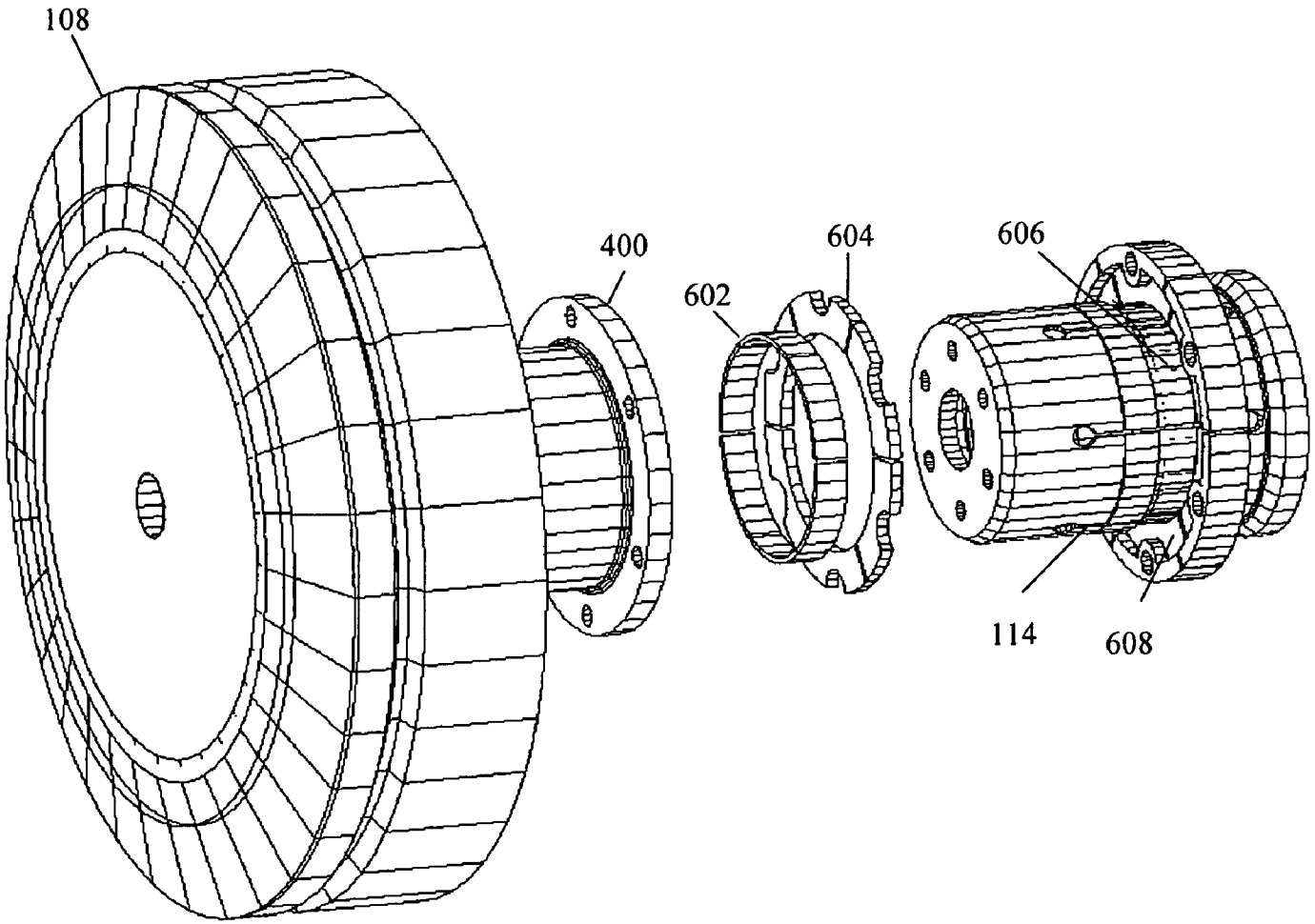
FIG. 6 is a perspective exploded view of a target anode assembly with nickel foam in accordance with an embodiment of the present invention.

FIG. 6 is a perspective exploded view of the target member 108 with Nickel foam positioned therein in accordance with an embodiment of the present invention. In this embodiment, the nickel foam is positioned in slots within thermal barrier member 114. A first foam member 602 is provided in the longitudinal direction in slot 606 of thermal barrier member 114. Similarly, a second foam member 604 is provided in the lateral direction in slot 608 of the thermal barrier member 114. Foam members 602 and 604 may be, for example, shrink fitted to the slots provided in thermal barrier 114. During shrink fitting, heat is used to produce a strong joint between the foam members and thermal barrier 114. Heating causes the foam members to expand and subsequently contract on to thermal barrier 114, producing interference and pressure that hold the members together mechanically. With this thermal barrier-foam coupled design, the rotational forces as well as the static forces (e.g., weight of the target) are provided to the interference joint between the foam and the thermal barrier and the bolted joint at that location. Use of multiple foams in the lateral and longitudinal direction provides thermal protection by blocking conduction in all directions at the joint between the target neck member 110 and the thermal barrier member 114. Essentially, the foam resists heat flow at the various contact points of the target neck member 110 and thermal barrier member 114. The shape and design of foam members 602 and 604 are further described in connection with FIG. 10.

The slots 606 and 608 in the thermal barrier member 114 also ensure space compatibility and avoid changes in other design parameters. It should be noted that the slots 606 and 608 as described above are only exemplary in nature and in no way limit the scope of the various embodiments of the present invention, which may be implemented using other structures, for example, pockets for positioning foam therein or by positioning the foam in the region between connection members or joints, such as between the thermal barrier member 114 and the target neck member 110. However, the positioning, configuration and orientation of the metallic foam may be modified as desired or needed.

Figure 7:
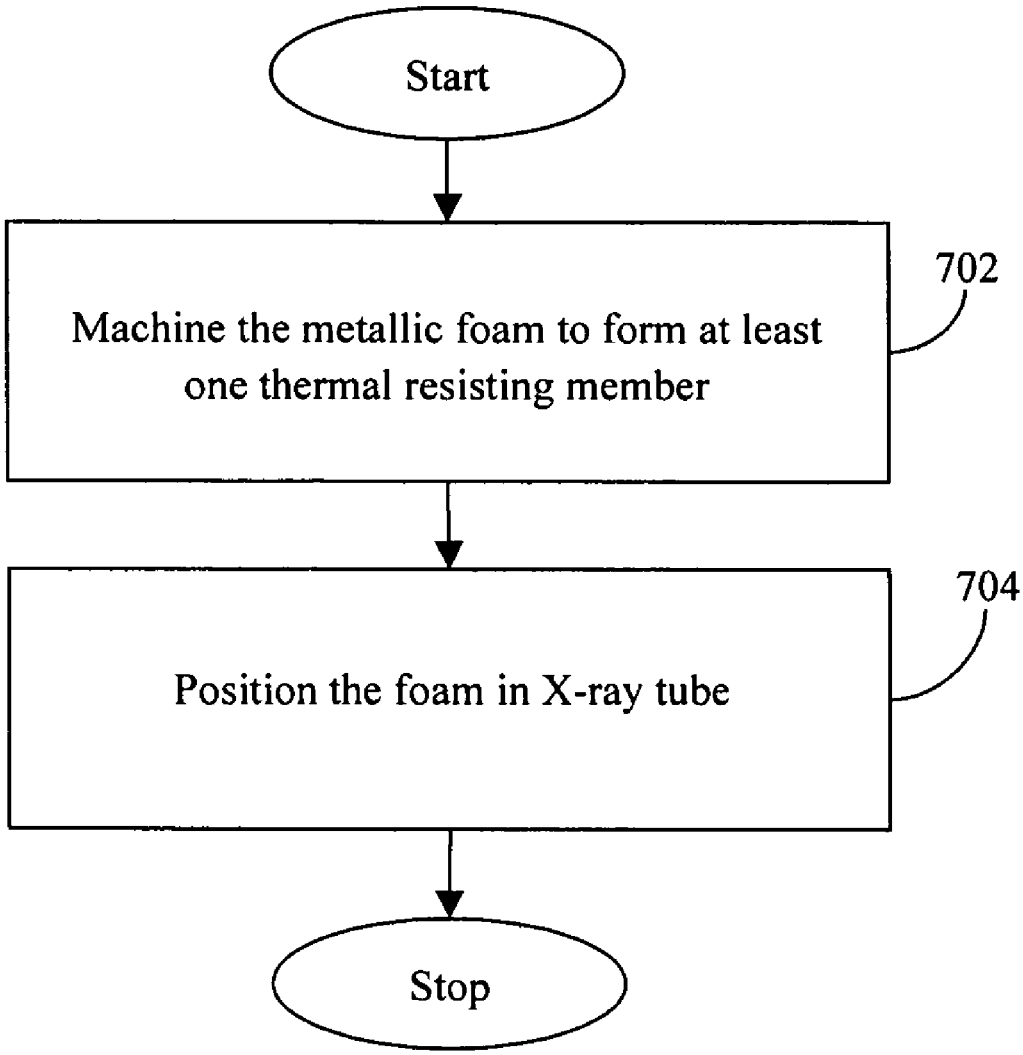
FIG. 7 is a flowchart illustrating a process for positioning metallic foam insulation in a target assembly in accordance with an embodiment of the present invention.

FIG. 7 is a flowchart illustrating a process for positioning metallic foam insulation in the target member 108 in accordance with an embodiment of the present invention. At 702, a metallic foam is attached to the thermal barrier member 114. In one embodiment, this includes positioning first foam member 602 in slot 606 and second foam member 604 in slot 608 (shown in FIG. 6). If only one foam member is used, that foam member is positioned in the appropriate slot. For example, the foam member may be attached by ultrasonically welding the foam to the slots. Other joining processes such as brazing may be used for attaching the foam to the thermal barrier member 114 or other components depending upon the design and joint shape or configuration. Adhesives that sustain the operating conditions without physical or chemical degradation also may be used for securing the foam in the slots.

At 704, the foam is attached to the target neck member 110, for example, by shrink fitting the thermal barrier member 114 mounted with the metallic foam to the target neck member 110. It should be noted that the process of shrink fitting has been described in connection with FIG. 6. Upon shrink fitting, densification of foam occurs. During shrink fitting, due to the expansion and contraction process, a load is applied on the foam. Under the load, the foam densifies on the skin surface to some depth, depending upon its Young's modulus and other mechanical properties. Densification of foam refers to pores being collapsed and receiving the load. Densification of foam ensures that the load is not transmitted through its thickness. For example, Nickel foams with a porosity of around 85% (Young's modulus of 160 Mpa) may provide densification properties as desired or needed. Densification provides rotational retention, for example, at the interference joint. Also, this densified foam layer along with the slots in the thermal barrier member 114 maintains the interference fit during the thermal expansion/contraction of the thermal barrier member 114 during operation of the X-ray tube 100 (shown in FIG. 1) and while changes in loading protocols are occurring.

Figure 8:
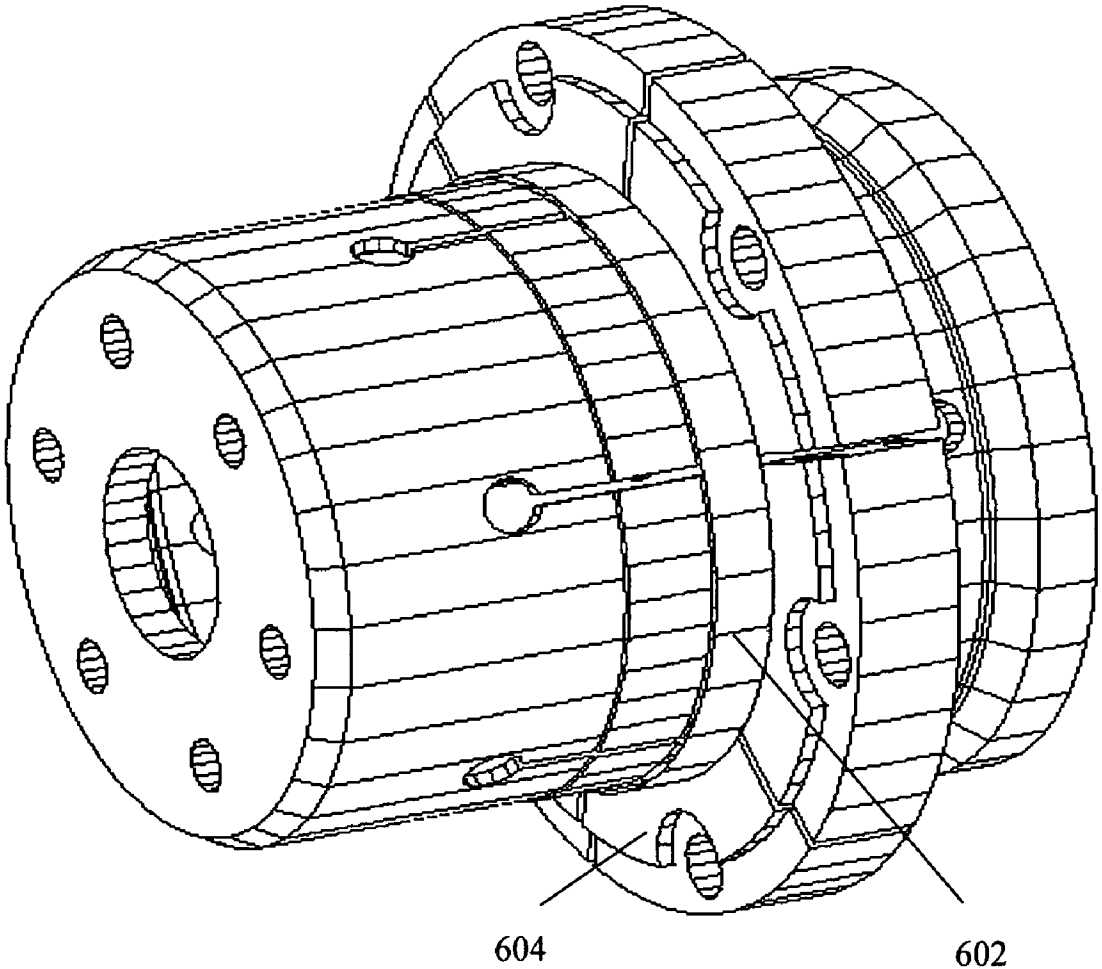
FIG. 8 is a perspective view showing a metallic foam in slots of a target assembly in accordance with an embodiment of the present invention.

FIG. 8 is a perspective view showing a metallic foam in the slots of a target assembly in accordance with an embodiment of the present invention. Foam members 602 and 604 are securely positioned and attached into slots 606 and 608 (both shown in FIG. 6) and may be provided to allow for shrink fitting.

Figure 9:
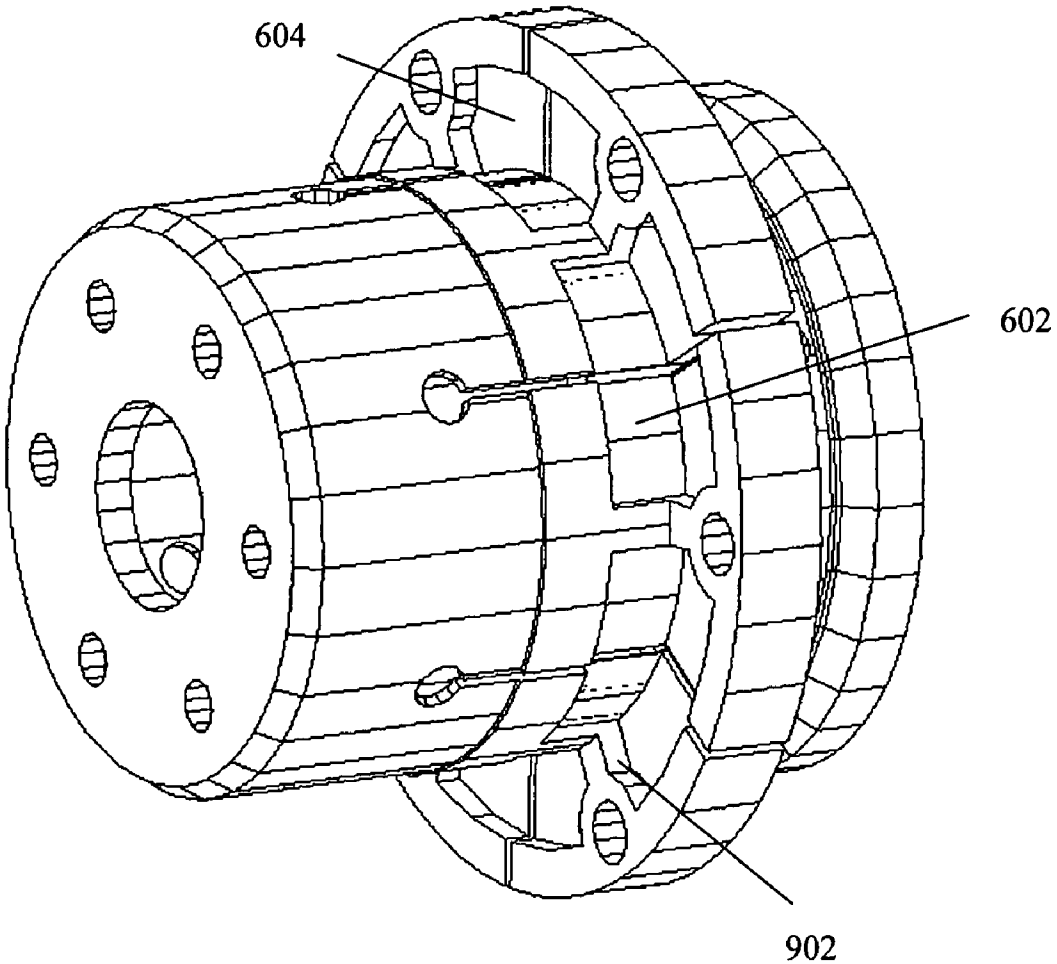
FIG. 9 is a perspective view showing a metallic foam in slots of a target assembly with an L-shaped bar design in accordance with an embodiment of the present invention.

In another exemplary embodiment of the present invention, an L-shaped bar design may be used for fitting metallic foam to a thermal barrier member. FIG. 9 is a perspective view showing a metallic foam in the slots of a target assembly with an L-shaped bar design in accordance with an embodiment of the present invention. The thermal barrier design includes L-shaped bars 902 that connect a bolted joint to the face of the target neck. The L-shaped bars 902 provide the desired shrink fit during expansion and contraction of the thermal barrier and provide rotational retention at high rotational speeds of the target assembly. The width of the L-shaped bars 902 can be optimized to provide for a required rotational retention, as well as structural stability, along with an optimal thermal insulation. Before shrink fitting, the L-shaped bars 902 protrude out of the plane of the thermal barrier member to allow shrink fitting to the target assembly. This also ensures that the foam welded in the sides of the L-shaped bars 902 does not move.

Figure 10:
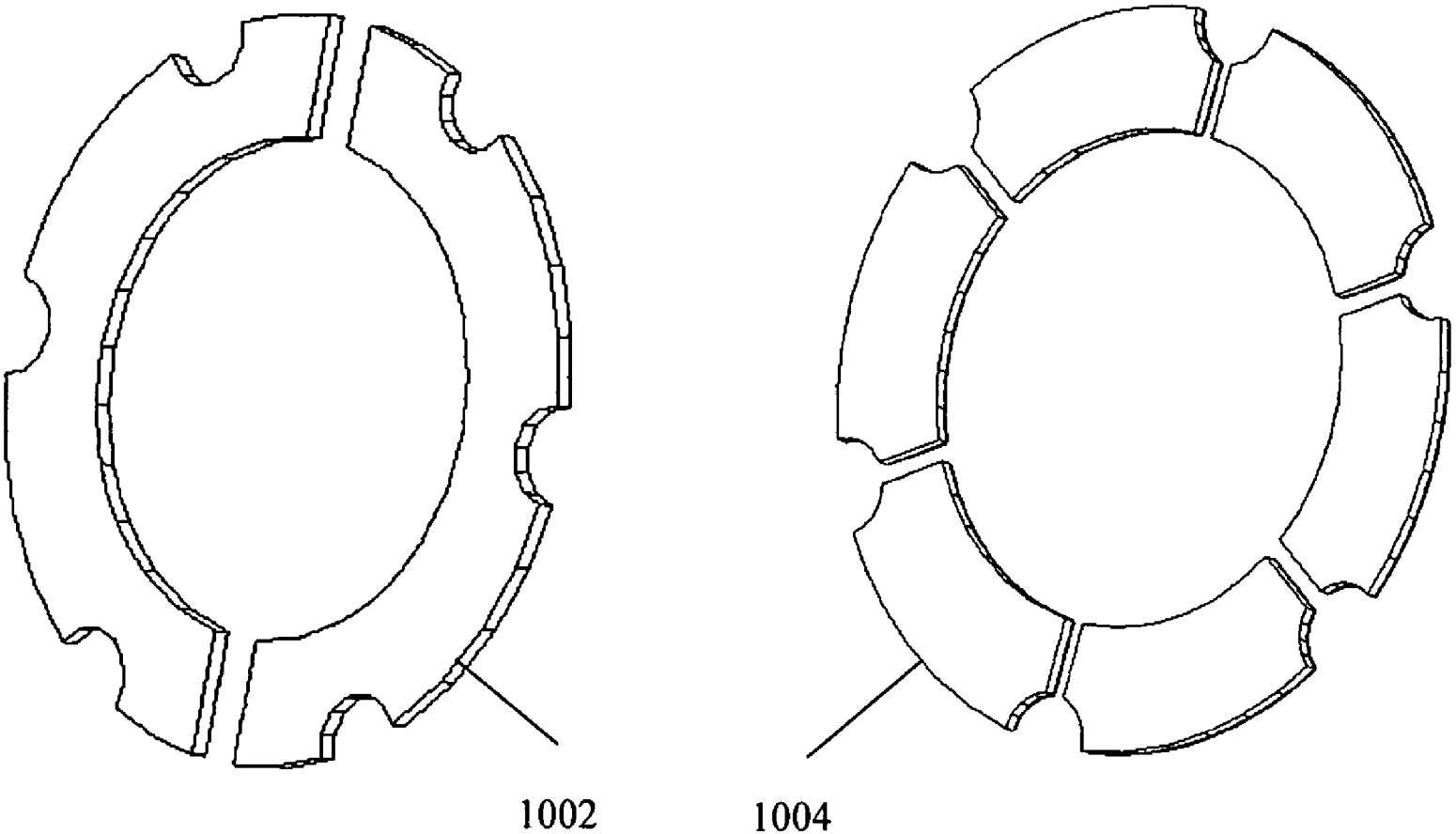
FIG. 10 is a perspective view of exemplary configurations of metallic foam in accordance with various embodiments of the present invention.

FIG. 10 is a perspective view of exemplary configurations of metallic foam in accordance with various embodiments of the present invention. The foam may be constructed (e.g., machined) in different multi-piece designs, such as, for example, a two-piece design 1002 or a six-piece design 1004 based on the design of the thermal barrier member or X-ray tube. Six-piece design 1004 may be used for thermal barrier members with L-shaped bars 902. Two-piece design 1002 may be used for thermal barrier elements that do not incorporate L-shaped bars 902 for rotational retention. Various other configurations may be used for the foam depending upon the positioning of the foam and other space constraints and/or as desired or needed. Two-piece design 1004 with L-shaped bars provides improved rotational retention because L-shaped bars 902 are constructed of the same material as the thermal barrier and provide a better shrink fitting with the target member than the foam member during thermal cycles of the target member.

In applications where out-gassing or vacuum compatibility of the foam members is an issue, the foam may be entirely covered with a sheet of metal to ensure that there is no contact with the vacuum atmosphere. Further, the issue of out-gassing may be addressed by other known techniques like vacuum casting and layer deposition techniques.

Various embodiments of the present invention provide thermal management (e.g., resist heat flow) with an X-ray tube, such as, for example, to the bearings in the anode assembly, particularly at high thermal and mechanical loads, by reducing the temperature at the bearings. Lowering the bearing temperature increases life and ability to withstand high loads. Further, the same bearings may be used in different tubes with minimal modifications in the target neck-rotor joint design. The foam may be placed or positioned in other regions of the anode or cathode assembly for thermal protection as described herein. Further, the foam may be configured and positioned in another area within an imaging tube as desired or needed.

Use of metallic foam as described in various embodiments of the present invention also reduces the noise levels of bearings acting as a sound absorber. Further, the foam is vacuum compatible, such that the foam retains its strength and chemical properties while reducing the possibility of degrading under the operating conditions inside an imaging tube. The low density of the foam also results in minimal or insignificant weight increase of the imaging tubes. In addition, the various embodiments maintain the electrical conductivity path in an imaging tube, for example, through the bolts.

While the present invention has been described in terms of various specific embodiments, those skilled in the art will recognize that the present invention can be practiced with modification within the spirit and scope of the claims.

What is claimed is:

1. A method for providing thermal insulation in an X-ray tube, said method comprising:

processing a metallic foam comprising a metal matrix, to resist heat flow and to conduct electricity in an X-ray tube;

forming the metallic foam for positioning in the X-ray tube between a cathode assembly and a rotor to resist axial and radial heat flow to bearings in the X-ray tube including forming a densified foam layer; and shrink fitting the metallic foam such that the metallic foam densifies proximate a surface within the X-ray tube.

2. A method in accordance with claim 1 further comprising determining the positioning of the metallic foam in the X-ray tube to resist axial and radial heat flow to bearings in the X-ray tube based on at least one of the configuration and operating characteristics of the X-ray tube.

3. A method in accordance with claim 1 further comprising positioning the metallic foam in the X-ray tube to resist axial and radial heat flow to the bearings.

4. A method in accordance with claim 1 wherein the metallic foam comprises at least nickel.

5. A method in accordance with claim 1 wherein the metallic foam comprises a plurality of metallic components.

6. A method in accordance with claim 1 further comprising positioning the metallic foam to not affect the electrical conductance path.

7. A method in accordance with claim 1 further comprising forming the metallic foam for positioning at a predetermined location in the X-ray tube.

8. A method in accordance with claim 1 further comprising forming the metallic foam to secure to a joint member between a target neck and a thermal baffler member in the X-ray tube.

9. A method in accordance with claim 1 further comprising positioning the metallic foam to secure to a thermal barrier member in the X-ray tube.

10. A method in accordance with claim 1 further comprising processing the metallic foam to have a porosity of greater than about eighty percent.

11. A method in accordance with claim 1 further comprising processing the metallic foam to have a porosity of greater than about ninety percent.

12. A method in accordance with claim 1 further comprising forming the metallic foam for positioning in an X-ray tube insert.

13. A method in accordance with claim 1 further comprising forming the metallic foam for positioning in an X-ray tube in connection with an anode of the X-ray tube.

14. A method in accordance with claim 1 further comprising forming the metallic foam for positioning in at least one slot formed in the X-ray tube.

15. A method in accordance with claim 1 further comprising shaping the metallic foam to form at least one thermal resisting member for positioning in the X-ray tube.

16. A method in accordance with claim 1 further comprising processing the metallic foam to resist heat flow at a vacuum level within the X-ray tube.

17. A method in accordance with claim 1 further comprising processing the metallic foam to resist heat flow at a pressure level of between about 10-3 and about 10-6 torr within the X-ray tube.

18. A method in accordance with claim 1 wherein the metallic foam comprises at least one of nickel, titanium and aluminum.

19. A method in accordance with claim 1 further comprising processing the metallic foam to resist heat flow at a temperature of greater than about 500 degrees Celsius in the X-ray tube.

20. A method in accordance with claim 1 further comprising welding the metallic foam to the X-ray tube.

21. A method in accordance with claim 1 further comprising machining the metallic foam for positioning in the X-ray tube.

22. A method for resisting heat flow to bearings within an X-ray tube, said method comprising:

forming a metallic heat resisting foam based on at least one of a configuration and operating characteristics of an X-ray tube;

orienting the metallic heat resisting foam for positioning in the X-ray tube between a cathode assembly and a rotor for resisting axial and radial heat transfer to bearings in the X-ray tube; and shrink fitting the metallic heat resisting foam to a portion of the X-ray tube such that the metallic foam densifies proximate a surface within the X-ray tube.

23. A method in accordance with claim 22 further comprising positioning the metallic heat resisting foam in one of an X-ray tube insert and an anode in the X-ray tube to resist axial and radial heat transfer to the bearings.

24. A method in accordance with claim 22 wherein the operating characteristic comprises at least one of temperature, force and pressure.

25. A method in accordance with claim 22 wherein the forming comprises forming the metallic heat resisting foam to have a porosity of greater than about eighty percent.

26. A method in accordance with claim 22 wherein the orienting comprises positioning the metallic heat resisting foam to secure between a target member and a thermal baffler member in the X-ray tube.

27. An X-ray tube comprising:

an X-ray tube target member;

a thermal baffler member connected to the X-ray tube target member; and a metallic thermal resisting foam, comprising a metal matrix, wherein the metallic thermal resisting foam is shrink fit such that the metallic foam densifies proximate a surface within the X-ray tube between a cathode assembly and a rotor, the metallic thermal resisting foam having a densified foam layer and configured to resist axial and radial heat flow to bearings in the X-ray tube and configured to conduct electricity within the X-ray tube.

28. An X-ray tube in accordance with claim 27 further comprising at least one slot formed in the thermal barrier member and wherein the metallic thermal resisting foam is configured to be secured in the at least one slot.

* * * * *